US009770117B1

(12) United States Patent
Torbet et al.

(10) Patent No.: US 9,770,117 B1
(45) Date of Patent: Sep. 26, 2017

(54) MATTRESS AND TOPPER WITH VARIABLE AND ADJUSTABLE DEFLECTION AREAS FOR ULTRA-LOW PRESSURES WITH POSTURAL ALIGNMENT

(71) Applicant: PERFECT PRESSURE INC., Montreal (CA)

(72) Inventors: Philip Alan Torbet, San Rafael, CA (US); Earl Takefman, Montreal (CA)

(73) Assignee: Perfect Pressure Inc., Montreal (CA)

( * ) Notice: Subject to any disclaimer, the term of this patent is extended or adjusted under 35 U.S.C. 154(b) by 0 days.

(21) Appl. No.: 15/461,207

(22) Filed: Mar. 16, 2017

Related U.S. Application Data

(60) Provisional application No. 62/335,959, filed on May 13, 2016, provisional application No. 62/422,154, filed on Nov. 15, 2016.

(51) Int. Cl.

| | |
|---|---|
| ***A47C 31/12*** | (2006.01) |
| ***A47C 27/15*** | (2006.01) |
| ***A47C 27/14*** | (2006.01) |
| ***A47C 27/00*** | (2006.01) |

(52) U.S. Cl.
CPC ..... *A47C 31/123* (2013.01); *A47C 27/007* (2013.01); *A47C 27/148* (2013.01); *A47C 27/15* (2013.01)

(58) Field of Classification Search
CPC ..... A47C 27/14; A47C 27/142; A47C 27/148; A47C 27/144; A47C 27/146; A47C 27/15
See application file for complete search history.

(56) References Cited

U.S. PATENT DOCUMENTS

| | | | | |
|---|---|---|---|---|
| 1,914,661 A * | 6/1933 | Burke | A47C 27/001 5/722 |
| 5,111,542 A * | 5/1992 | Farley | A47C 27/148 5/727 |
| 5,533,218 A * | 7/1996 | Fahy | A47C 27/144 5/421 |
| 5,960,497 A * | 10/1999 | Castellino | A47C 27/146 5/665 |
| 6,061,856 A * | 5/2000 | Hoffmann | A47C 27/148 5/706 |
| 6,935,382 B2 * | 8/2005 | Buckley | D03D 1/00 139/391 |

(Continued)

*Primary Examiner* — Eric J Kurilla
(74) *Attorney, Agent, or Firm* — Damien Calvet

(57) ABSTRACT

It is disclosed foam mattresses or toppers, and methods of using them, comprising a top surface defining lateral deflective areas thanks to structural modifications of the foam comprising a plurality of slots, grooves, voids or channels. The invention (mattresses, toppers or methods) allows controlling postural alignment while providing ultra-low mattress-body interface pressures for all body areas regardless of recumbent position. The method comprises the step of providing into a core section of the mattress a plurality of structural modifications comprising slots, and/or voids, to form transversal deflective areas into the mattress. The invention is preferably achieved by CNC (Computer Numerical Control) cutting the structural modifications (channels, slots and voids) into the mattress foam which support each area of the body. It is also disclosed mattresses or toppers in which foam inserts are kept or removed from the channels to modulate the deflections on one or both sides of the mattress.

8 Claims, 14 Drawing Sheets

(56) References Cited

U.S. PATENT DOCUMENTS

| | | | | |
|---|---|---|---|---|
| 7,594,288 | B1 * | 9/2009 | Holliday | A61F 5/56 5/630 |
| 2014/0259429 | A1 * | 9/2014 | Clayton | A47C 27/15 5/691 |
| 2015/0015402 | A1 * | 1/2015 | Boyd | A47C 27/085 340/626 |
| 2015/0250327 | A1 * | 9/2015 | Boyd | A47C 27/085 705/26.7 |

* cited by examiner

MATTRESS AND TOPPER WITH VARIABLE AND ADJUSTABLE DEFLECTION AREAS FOR ULTRA-LOW PRESSURES WITH POSTURAL ALIGNMENT

CROSS-REFERENCE TO RELATED APPLICATIONS

The present patent application claims the benefits of priority of U.S. Patent Applications No. 62/335,959, entitled "Mattress and Topper with Variable Area Deflection Means for Ultra-low Pressures with Postural Alignment", and filed at the U.S. Patent Office on May 13, 2016, and No. 62/422,154, entitled "Mattress and Topper with Variable and Adjustable Area Deflection Means for Ultra-low Pressures with Postural Alignment", and filed at the U.S. Patent Office on Nov. 15, 2016, the content of which is incorporated herein by reference.

FIELD OF THE INVENTION

The present invention belongs to the field of mattresses and/or toppers and relates in particular to modifications of foam mattresses or toppers to reduce high mattress-body interface pressures while maintaining postural alignment.

BACKGROUND OF THE INVENTION

It is known that the quality of sleep has a significant effect on the quality of life. Multiple clinical studies have correlated poor sleep quality with hypertension, obesity, stroke and diabetes. It is also known that mattresses can significantly affect sleep quality.

All existing consumer mattresses impart sleep-disturbing side-lying interface pressures to the body. Mattress-induced discomfort caused by excessive body pressures and postural misalignment result in increased tossing and turning causing sleep disruption and reduced sleep quality. An ideal mattress must have the support and resiliency over the length of the body to support the body in postural alignment while also providing ultra-low body pressures on all parts of the body in contact with the mattress to reduce mattress pressure-induced sleep disturbance.

The object of this invention is to eliminate mattress-induced sleep quality degradation. The present invention is the result of many years of university sleep research and development. The construction of over 100 prototypes was required to solve the heretofore unsolved equation of providing ultra-low pressures with optimal postural alignment.

Ultra-low mattress body interface pressure can be defined as at or below 0.6 PSI (32 mmHg), medically known as the ischemic pressure threshold. This interface pressure between the mattress and body allow the capillaries of the skin to remain open thereby greatly reducing or eliminating the incidence of pressure-induced sleep-disrupting movement. This pressure, if unrelieved, would eventually cause a decubitus ulcer (bed sore) to form.

Side sleeping is the most common and desired sleep position. Most existing consumer mattresses achieve back-lying body pressures on most, but not all parts of the body, of 0.6 PSI. If the back-lying area is about 900 square inches, that is usually sufficient area to maintain low pressures on most parts of the body. But the same side-lying body only presents about 500 square inches of contact area which, under the same load, significantly increases the unit area pressure to higher than 0.6 PSI on some parts of the body, notably the shoulder and hip areas, also known as bony prominences.

Achieving 0.6 psi or below on all body areas, including the shoulder and hip areas, when side-lying on static conventional mattresses—without certain mattress structural modifications—cannot be achieved with current materials. Prototypes leading to the present invention have achieved side-lying pressures on the shoulder and hip—as well as the rest of the body—of significantly less than 0.6 psi.

Since a recumbent body has both varying density and contour in the longitudinal direction, the ideal mattress must conform (deflect) to these variations in order to achieve correct postural alignment. The deflection parameters of the mattress must vary along its length to match the varying body density and contours while maintaining interface pressures at or below 0.6 PSI.

New foam mattresses and toppers by the inventor using foam deflection are disclosed in international application no. WO 2016/023109 A1 (Torbet) wherein the top portion of the mattresses comprises a plurality of displacement tunnels at different body part areas, such as shoulders or hip area, allowing the body part area foam above the tunnel to displace downward to provide pressure reduction and alignment for the body part such as shoulders or hip. Although the invention disclosed in this international application is pretty efficient, there is place for improvement in the shape, number and location of the channels for improving or modulating pressure reduction, alignment and comfort.

SUMMARY OF THE INVENTION

The shortcomings of the prior art are generally mitigated by new foam mattresses and toppers comprising deflective areas for reducing pressure reduction and alignment for the body parts in contact with the deflective areas.

The invention is first directed to a foam mattress or topper for controlling a whole body alignment of a person laid on the foam mattress or topper, and comprising:

- an upper and lower surface, the upper surface defining:
  - a longitudinal direction allowing for longitudinally receiving the person, and
  - a plurality of mattress areas comprising:
    - an upper body receiving area for supporting the person's upper body and shoulders;
    - a lower body receiving area for supporting the person's lower body; and
    - a middle body receiving area for supporting the person's hip;
  - a plurality of first lateral channels extending from the lower surface into the upper body receiving area and extending in a lateral direction perpendicular to the longitudinal direction of the mattress or topper; the first lateral channels thereby allowing the upper body receiving area above the first lateral channel to displace downward to provide pressure reduction and alignment for the shoulder of the user's body; and
  - at least one first insert, each first insert being made of a same foam than the mattress or topper and configured to fill, at least partially, at least one of said first lateral channels for modulating the pressure reduction and alignment for the shoulder of the user's body.

According to a preferred embodiment, each of the at least one first insert is made of a same foam than the mattress or topper and is obtained by cutting out the foam from the mattress or topper to form said plurality of first lateral channels during the manufacture of the mattress or topper.

According to a preferred embodiment, the mattress or topper has a width long enough to accommodate two persons, each on one side of the mattress or topper. The at least one inserts are either full-length inserts configured to fill the width of the mattress or topper allowing to modulate both sides of the mattress or topper; or the at least one inserts are half-length inserts configured to be placed on one side only allowing to modulate the pressure reduction and comfort on one side of the mattress or topper.

According to a preferred embodiment, the foam mattress or topper further comprises a second lateral channel extending from the lower surface into the middle body receiving area and extending in the lateral direction perpendicular to the longitudinal direction of the mattress; the second lateral channel thereby allowing the middle body receiving area above the second lateral channel to displace downward to provide pressure reduction and alignment for the hip of the person. Preferably, the foam mattress or topper further comprises a second insert made of the same foam than the mattress or topper and configured to fill, at least partially, the second lateral channel for modulating the pressure reduction and alignment for the hip of the person.

According to a preferred embodiment, the foam mattress or topper further comprises a plurality of third lateral channels extending from the lower surface into the lower body receiving area and in the lateral direction perpendicular to the longitudinal direction of the mattress or topper; the third lateral channels thereby allowing the lower body receiving area above the third lateral channel to displace downward to provide pressure reduction and alignment for the lower body of the person. Preferably, the foam mattress or topper further comprises at least one third insert made of the same foam than the mattress or topper and configured to fill, at least partially, at least one of the third lateral channels for modulating the pressure reduction and alignment for the lower body of the person.

The invention is also directed to a method for customizing or adjusting the postural alignment of a person laid on a foam mattress or topper, the method comprising the steps of:

providing a mattress or topper as defined herein; and removing, at least partially, at least one of the first inserts from the first lateral channels providing as such pressure reduction for the shoulder of the person; and/or reinserting, at least partially, at least one of the first inserts into the first lateral channels providing as such pressure augmentation for the shoulder of the person.

There are several advantages of the use of the removable inserts, also named enhancers hereinafter. First, the use of the enhancers allows precisely and easily customizing the user's sleeping comfort, one side of the bed or both sides. Second, the inserts or enhancers can be made from the cut-out of the foam mattress when cutting the channels reducing foam waste.

The invention is also directed to a foam mattress to control a whole body alignment of a person laid on the mattress, and comprising:

an upper and lower surface; the upper surface defining:

a longitudinal direction allowing for longitudinally receiving the person;

an upper body receiving area for supporting the upper body and shoulders of the person;

a lower body receiving area for supporting the lower body of the person; and a middle body receiving area for supporting a hip of the person;

a plurality of first lateral channels extending from the upper surface into the upper body receiving area in a lateral direction perpendicular to the longitudinal direction of the mattress; the first lateral channels thereby allowing the upper body receiving area adjacent to the first lateral channels to displace downward to provide pressure reduction and alignment for the upper body and shoulder of the person.

According to a preferred embodiment, the foam mattress further comprising a second lateral channel extending from the upper surface into the middle body receiving area in the lateral direction perpendicular to the longitudinal direction of the mattress; the second lateral channel thereby allowing the middle body receiving area above the second lateral channel to displace downward to provide pressure reduction and alignment for the hip of the person.

According to a preferred embodiment, the foam mattress further comprises a plurality of third lateral channels extending from the upper surface into the lower body receiving area in the lateral direction perpendicular to the longitudinal direction of the mattress; the third lateral channels thereby allowing the lower body receiving area above the third lateral channels to displace downward to provide pressure reduction and alignment for the lower body of the person. Preferably the first foam section is symmetrical from the upper body receiving area to the lower body receiving area.

According to a preferred embodiment, the foam mattress further comprises a foam topper having a bottom surface matching the lower surface of the mattress for covering the mattress and the plurality of first lateral channels.

According to a preferred embodiment, the foam mattress further comprises two lateral grooves extending from the upper surface with one lateral groove delimiting the upper and middle body receiving areas and the second lateral groove delimiting the middle and lower body receiving areas, each lateral groove being defined by a first lateral edge and a second lateral edge at an angle from the first lateral edge. Preferably, the second lateral edge is at an angle of about 45 degrees from the first lateral edge.

According to a preferred embodiment, the first, second or third lateral channels may have a triangular cross-section with a vertex of the triangle forming an opening of the channel on the upper surface and an opposite edge to the vertex defining a bottom of the channel. The bottom of the channel may also define another lateral grove facing the vertex.

According to another preferred embodiment, the first lateral channels has a triangular cross-section with an edge of the triangle defining an opening of the channel adjacent to the upper surface and a vertex opposite to the edge and forming a bottom of the channel.

According to a preferred embodiment, the foam mattress further comprises at least one internal lateral channel operatively extending between two of said first lateral channels inside the mattress. More preferably, the foam mattress comprises one internal lateral channel between two of said first lateral channels, each internal lateral channel having an ovoid cross-section.

The foam mattress as described herein comprises a base core section having its top surface defining lateral or transversal deflective areas thanks to structural modifications of the foam comprising a plurality of slots, grooves, voids or channels.

The channels are preferably made of vertical and adjacent slots and/or voids cut into the foam for supporting each area of the person body in a specific way to control postural alignment while providing ultra-low mattress-body interface pressures for all body areas regardless of recumbent position.

Preferably, the mattress also comprises a top section or topper on which a person can be laid on, the top section being connected to the core section to form the mattress.

It is also disclosed a method for controlling postural alignment of a person laid on a foam mattress while providing ultra-low mattress-body interface pressures for all body areas regardless of recumbent position. The method comprises the step of providing into a core section of the mattress a plurality of structural modifications comprising slots, and/or voids, to form transversal deflective areas into the mattress.

The present invention is preferably achieved by CNC (Computer Numerical Control) cutting the structural modifications (channels, slots and voids) into the mattress foam which support each area of the body.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF PREFERRED EMBODIMENTS

A novel mattress and/or topper will be described hereinafter. Although the invention is described in terms of specific illustrative embodiments, it is to be understood that the embodiments described herein are by way of example only and that the scope of the invention is not intended to be limited thereby.

All mattress and toppers embodiments shown are preferably bi-directional, meaning that the head end and foot end of the mattress are identical and symmetrical. This allows the mattress or topper to be placed on the bed foundation in either direction without affecting sleep performance. Of course, the present invention cannot be limited to bi-directional mattresses and toppers.

Figure 1:
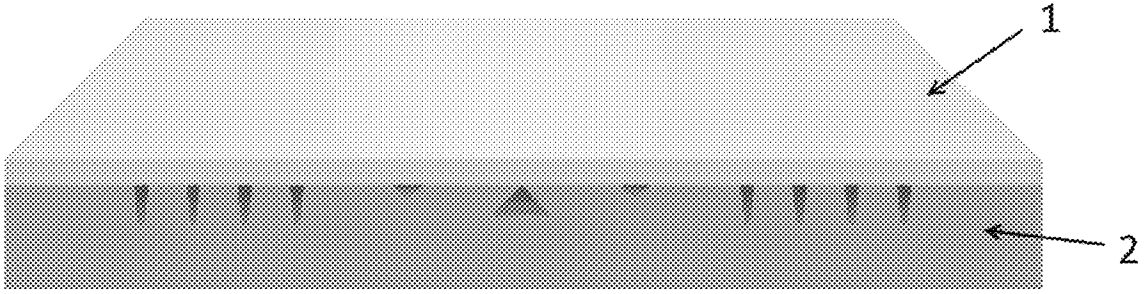
FIG. 1 is a schematic perspective view in cross-section of the core of the mattress in accordance with a first embodiment of the invention.
Figure 2:
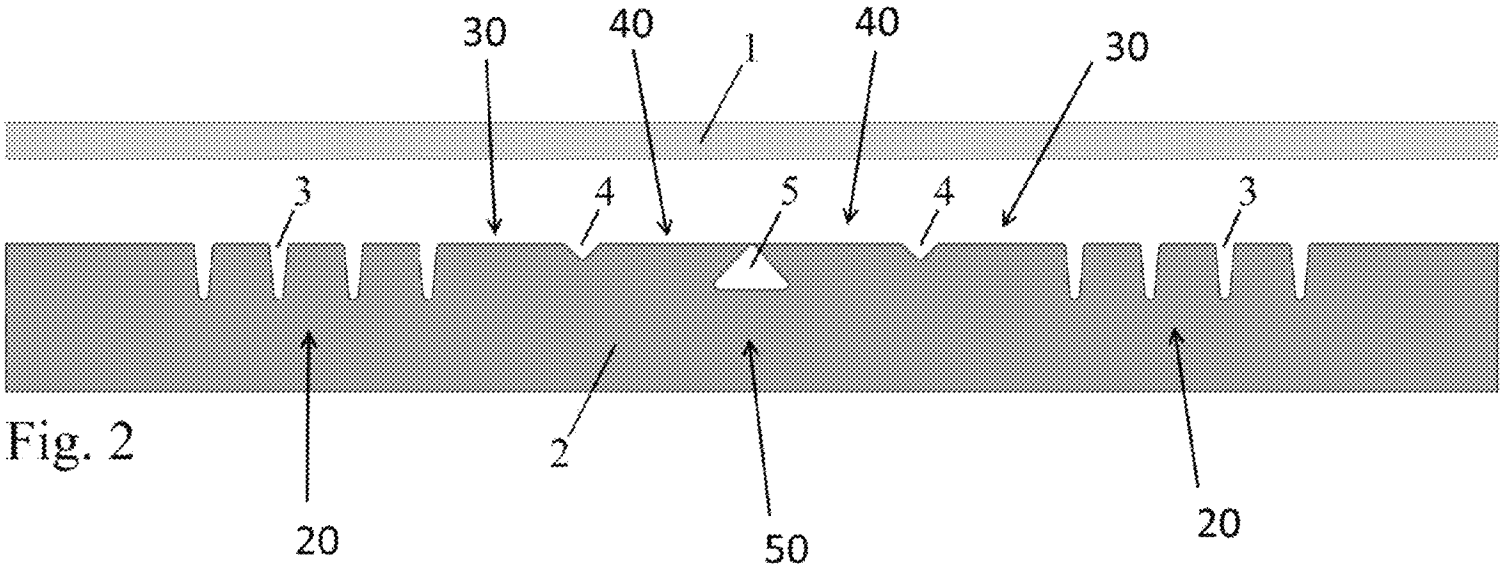
FIG. 2 is an exploded schematic front elevation view in cross-section of the core of the mattress in accordance with a first embodiment of the invention.

FIGS. 1 and 2 shows a first mattress base core in accordance with a first embodiment of the invention. The mattress is formed of two foam sections with a top section 1 adapted to be affixed on a bottom base or core section 2. The base core section can be a 8" base piece. The two sections can be glued but other methods known in the art can be used to assemble the two sections together.

Mattress Deflection Areas:

The core section 2 comprises various specific load deflection areas 20-50 which correspond to different recumbent body areas to reduce pressures to those areas while maintaining postural alignment. The areas are preferably CNC contour cut to create transversal longitudinal channels that can be either slots 3, grooves 4 or void 5.

The shoulder area 20 may comprise a series of slots 3, preferably parallel slots, for providing pressure reduction and shoulder deflection for postural alignment. A V-groove 4 can be placed between the torso area 30 and the pelvic area 40 to provide pelvic deflection. The void 5 is placed at the longitudinal mattress center to provide pressure reduction for the greater trochanter.

Figure 3:
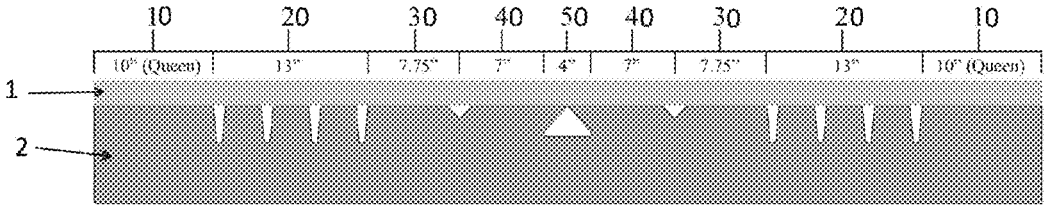
FIG. 3 depicts the first embodiment of FIGS. 1 and 2 with body area displacement modifications.

FIG. 3 better identifies each of the deflection-modified body areas: head area 10, shoulder area 20, torso area 30, pelvic area 40 and trochanter area 50 with examples of general lengths for each area. Since the mattress core in this example is bi-directional in placement orientation and deflection parameters, both areas 10, 20, 30 and 40 are identical in support and deflection.

High side-lying trochanter pressure exists in all current mattresses and is the most common cause of mattress-induced sleep disruption. The hip area is comprised of both areas 40 and area 50. Both areas 40, one supporting the pelvis and the other supporting the upper thigh, act together to redistribute and relieve the high pressure which would otherwise be placed on the greater trochanter. Area 50 further reduces trochanteric pressure. Likewise, the torso area 30 reduces pressure on the shoulder area 2.

Different Form of Channels:

FIGS. 4 to 11 illustrate different configurations and forms of the channels present in the mattress or topper in accordance with different preferred embodiments. While referring to the shoulder are in the following description, the same description of the slots may apply for the lower body area when the mattress is symmetrical.

Figure 4:
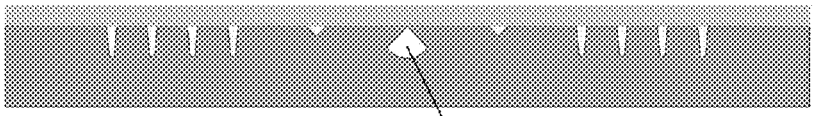
FIG. 4 is a schematic front elevation view in cross-section of the core of the mattress in accordance with a second embodiment of the invention.

FIG. 4 shows an embodiment where the trochanter area comprises a void 54 deeper than the void visible on FIG. 1 or 2, to reduce the possibility of trochanter contact with the bottom of the void.

Figure 5:
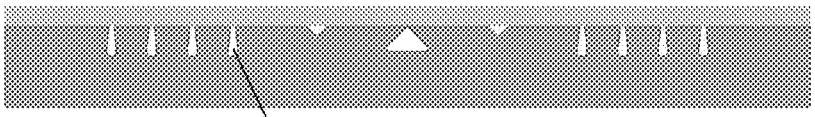
FIG. 5 is a schematic front elevation view in cross-section of the core of the mattress in accordance with a third embodiment of the invention.

FIG. 5 shows an embodiment with four inverted shoulder slots 15 which are narrower at the top than at the bottom of the slot.

Figure 6:
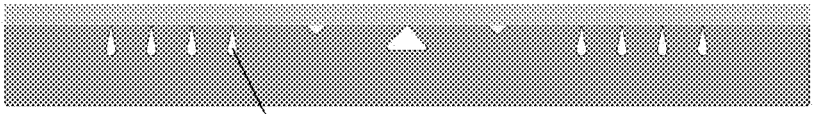
FIG. 6 is a schematic front elevation view in cross-section of the core of the mattress in accordance with a fourth embodiment of the invention.
Figure 7:
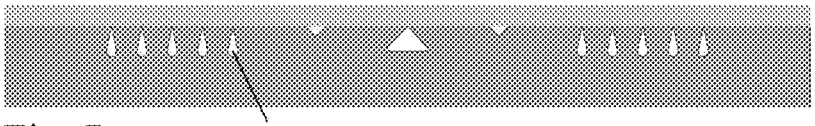
FIG. 7 is a schematic front elevation view in cross-section of the core of the mattress in accordance with a fifth embodiment of the invention.

FIG. 6 shows an embodiment with four inverted shoulder slots 16 having a drop-like shape closed at the top and in full contact with the top layer. FIG. 7 shows an embodiment with five inverted shoulder slots 17 instead of four slots as in FIG. 6, to further decrease shoulder pressure.

Figure 8:
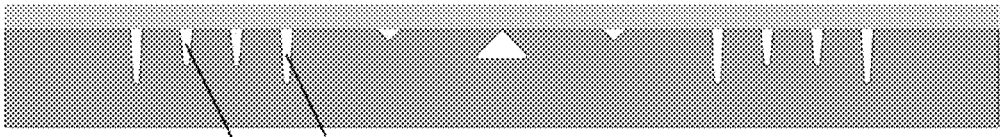
FIG. 8 is a schematic front elevation view in cross-section of the core of the mattress in accordance with a sixth embodiment of the invention.
Figure 9:
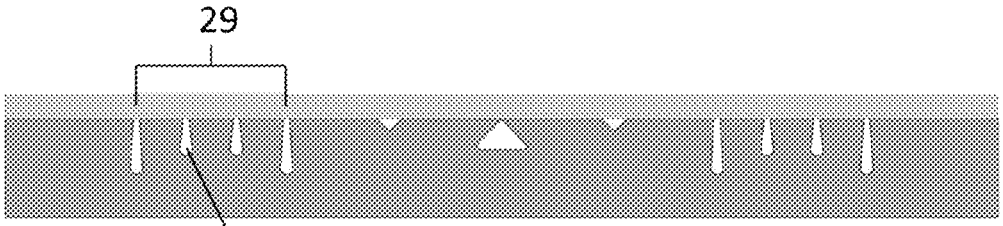
FIG. 9 is a schematic front elevation view in cross-section of the core of the mattress in accordance with a seventh embodiment of the invention.

FIGS. 8 and 9 show embodiments where the four shoulder slots, while presenting the same shape has different depths. As illustrated, the two external slots 28 or 29 are deeper than the two internal slots 18 or 19. The deeper slots allow greater deflection of the entire shoulder area 20.

Figure 10:
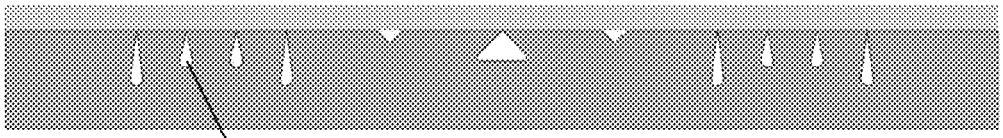
FIG. 10 is a schematic front elevation view in cross-section of the core of the mattress in accordance with a eighth embodiment of the invention.
Figure 11:
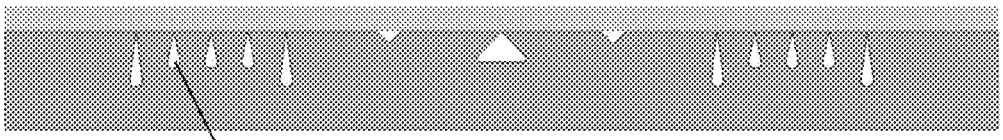
FIG. 11 is a schematic front elevation view in cross-section of the core of the mattress in accordance with a ninth embodiment of the invention.

FIGS. 10 and 11 show embodiments as above where the four shoulder slots, while presenting the same drop-like shape has different depths. In FIG. 10, there are two smaller internal slots 110 whereas in FIG. 11, there are three internal sluts 111, in both case having two deeper external slots.

Figure 12:
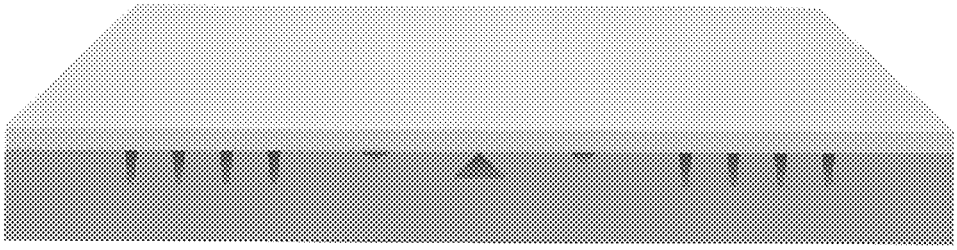
FIG. 12 is a schematic perspective view in cross-section of the core of the mattress in accordance with the first embodiment of the invention (FIG. 1)

Foam Deflection and Body Alignment:

FIG. 12 identical to FIG. 1 shows the first mattress core embodiment in perspective view for reference.

Figure 13:
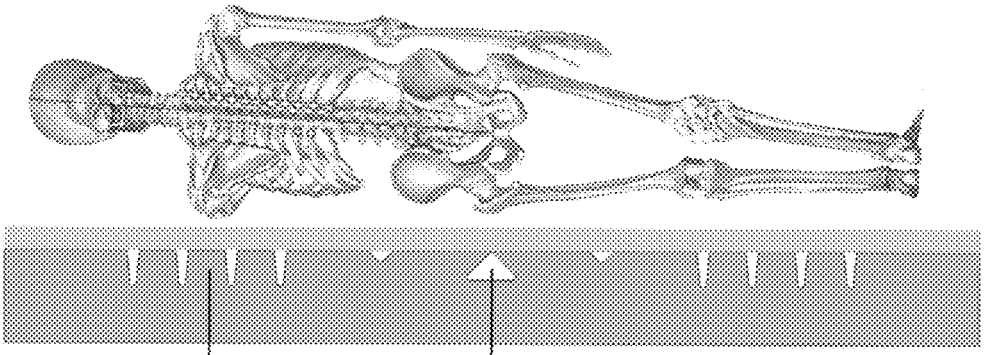
FIG. 13 is a schematic perspective view in cross-section of the core of the mattress in accordance with the first embodiment of the invention (FIG. 1 or 12) without side-lying body contact.
Figure 14:
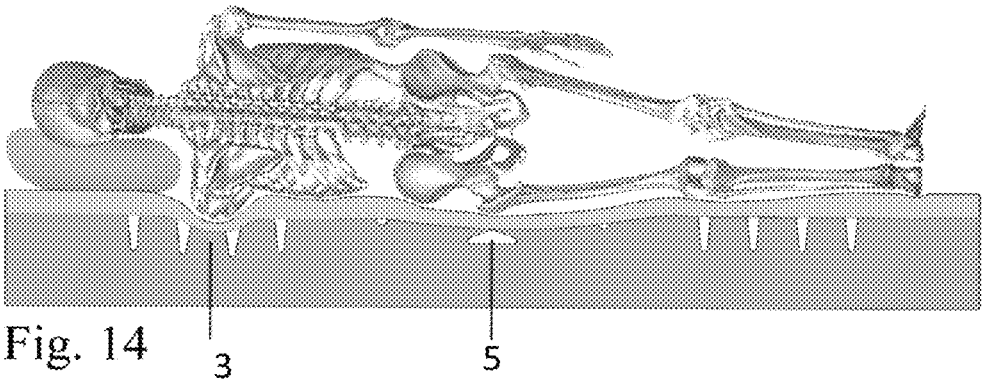
FIG. 14 is a schematic perspective view in cross-section of the core of the mattress in accordance with the first embodiment of the invention (FIG. 1 or 12) with side-lying body contact.

FIG. 13 shows the first mattress core embodiment without side-lying body compression. Shoulder support elements 3 are shown uncompressed. The trochanter void 5 is shown uncompressed. FIG. 14 shows the first mattress core embodiment with side-lying body compression. The slots are shown under various degrees of compression. The trochanter void 5 is shown compressed. The trochanter void 5 under compression allows the angled sides of the void to deflect, dramatically reducing pressure on the trochanter body area.

Figure 15:
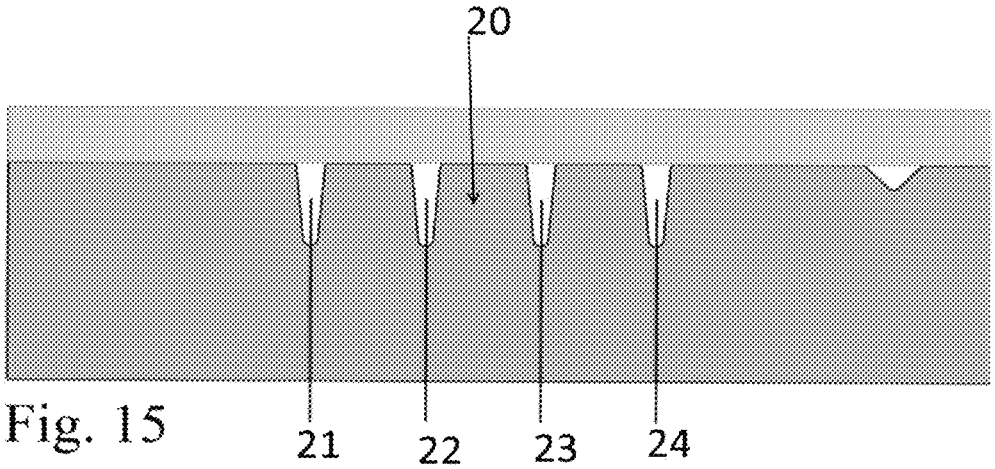
FIG. 15 depicts the shoulder area of the first embodiment without contact.
Figure 16:
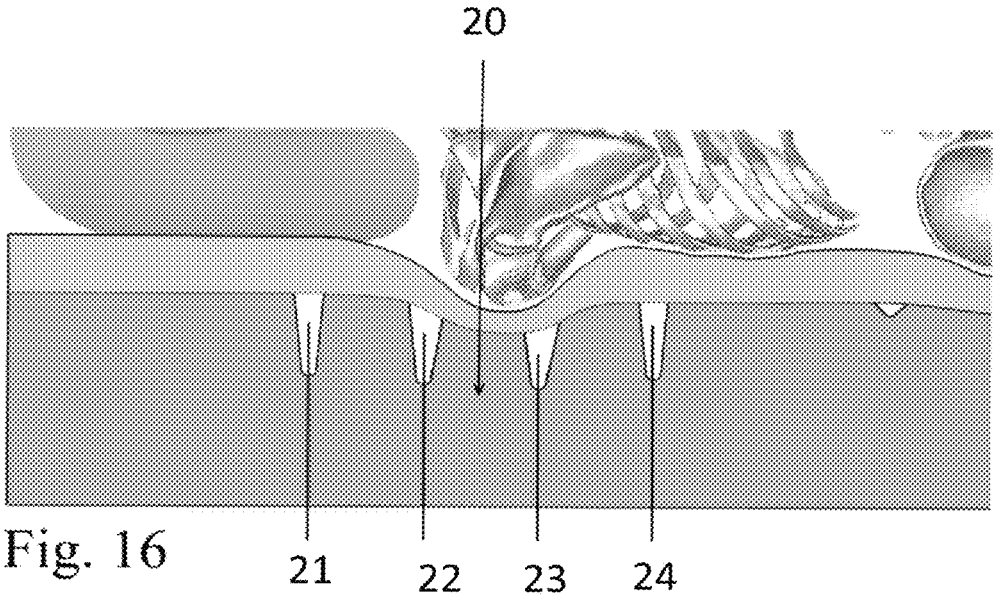
FIG. 16 depicts the shoulder area of the first embodiment with contact.

FIG. 15 details the shoulder area 20 uncompressed with the shoulder slots 21-24 in their as-cut relaxed positions. FIG. 16 details the shoulder area compressed. During shoulder compression, the shoulder support elements 20 compress independently. The shoulder slots 21, 22, 23 and 24 under compression expand horizontally to reduce the lateral foam tensile forces which would otherwise occur if the shoulder slots were not there to release the tensile forces. This lateral foam tensile force, if unrelieved, would dramatically increase the unit area pressure on the shoulder.

Figure 17:
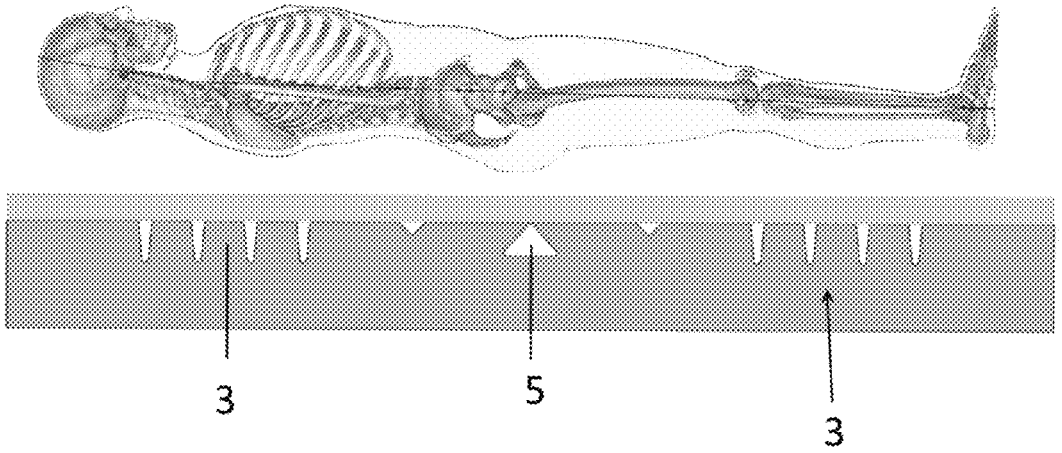
FIG. 17 depicts the first embodiment of FIG. 1 without back-lying body contact.
Figure 18:
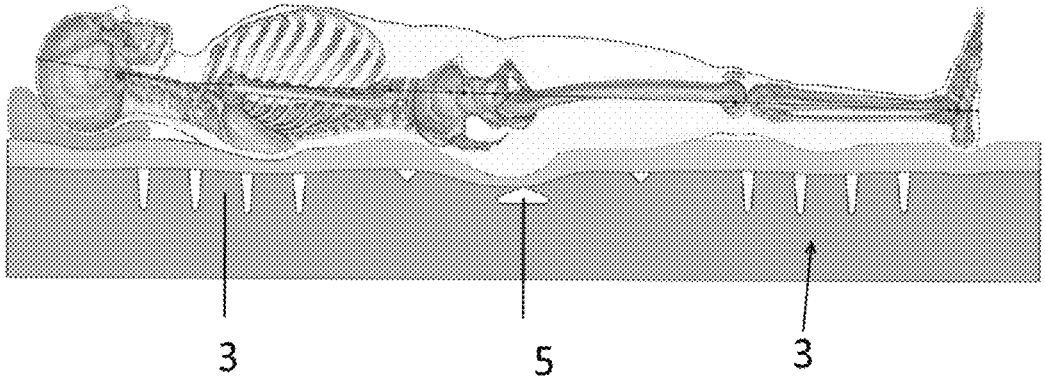
FIG. 18 depicts the first embodiment of FIG. 1 with back-lying body contact.

FIG. 17 shows the first mattress core embodiment without back-lying body compression. The slots 3 and mattress areas are shown uncompressed. The trochanter void 5 is also shown uncompressed. FIG. 18 shows the mattress with back-lying body compression. The shoulder support slots 3 are shown under various degrees of compression. The trochanter void 5 is also compressed. The trochanter void 5 under compression allows the angled sides of the void to deflect, allowing the buttocks area to deflect into the mattress. The deflection in this area creates significant additional support in the lumbar area when back-lying as well as allowing increased knee flexion which helps reduce low-back pain.

Additional Embodiments

Figure 19:
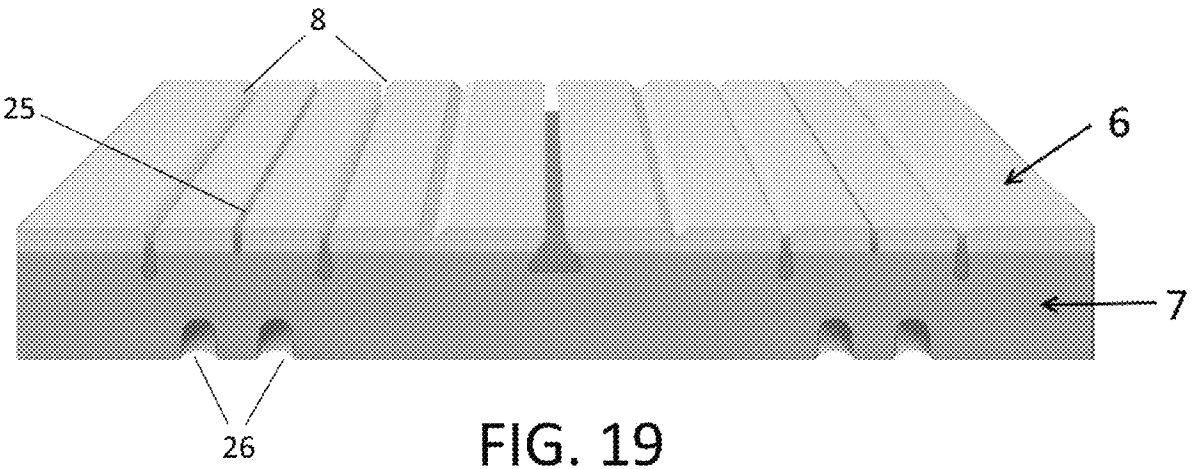
FIG. 19 is a schematic perspective view in cross-section of the core of the mattress with body area displacement modifications in accordance with a tenth embodiment of the invention.
Figure 20:
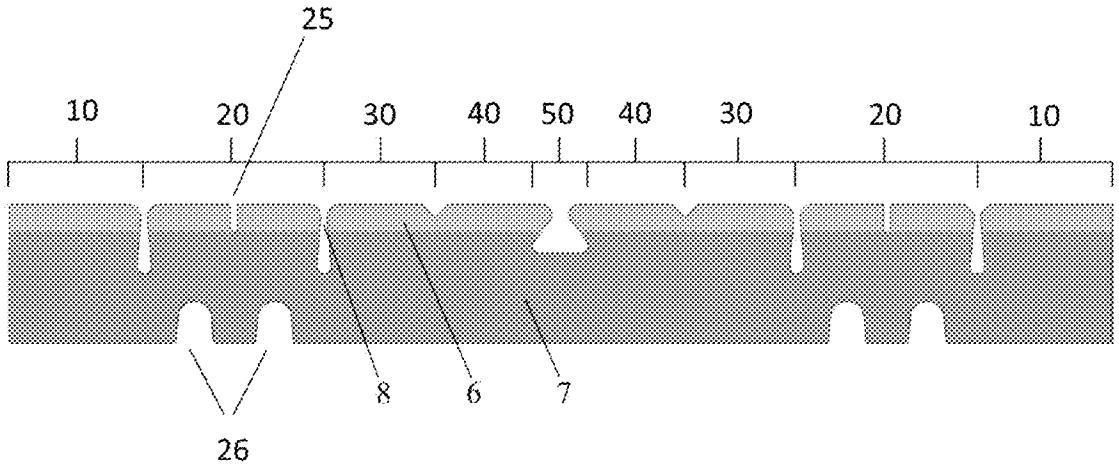
FIG. 20 is a schematic front elevation view in cross-section of the core of the mattress with body area displacement modifications in accordance with a tenth embodiment of the invention.

FIGS. 19 & 20 show another mattress embodiment comprised of a top foam layer 6 and a bottom foam layer 7. The four identical slots 8 extend from the upper surface through the mattress which eliminates the horizontal tensile forces present in the top foam layer 6 as shown in embodiments 1-9. This embodiment is comprised of nine specialized deflection areas: head area 10, shoulder area 20, torso area 30, pelvic area 40 and trochanter area 50. Since the mattress core is bi-directional in both placement orientation and deflection parameters, both areas 40 are identical in support and deflection. The hip area is comprised of both areas 40 and area 50. Both areas 40, one supporting the pelvis and the other supporting the upper thigh, act together to redistribute and relieve the high pressure which would otherwise be placed on the greater trochanter.

The shoulder or lower body area 20 also comprise a lateral slot 25 located between two slots 8, and two channels 26 extending from the lower surface of the mattress. The different slots 8, 25 and channels 26 collaborate for modifying the deflection of the foam under the body. The lower channels 26 can be used also for modulating such deflection by inserting inserts made of the same foam, as detailed herein below.

Figure 21:
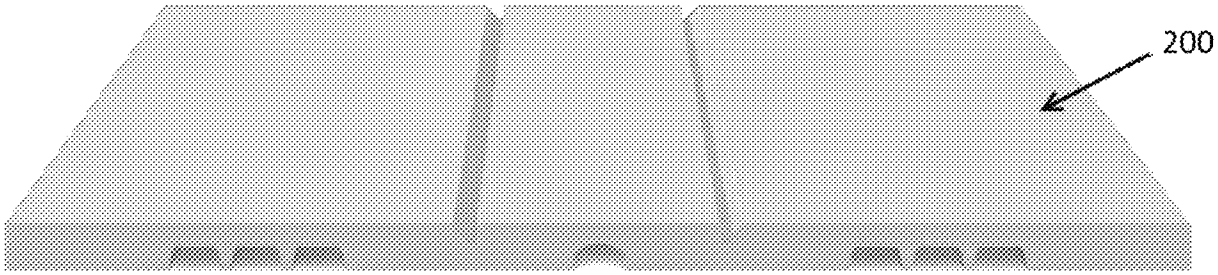
FIG. 21 is a schematic perspective view in cross-section of a topper with body area displacement modifications in accordance with a eleventh embodiment of the invention.
Figure 22:
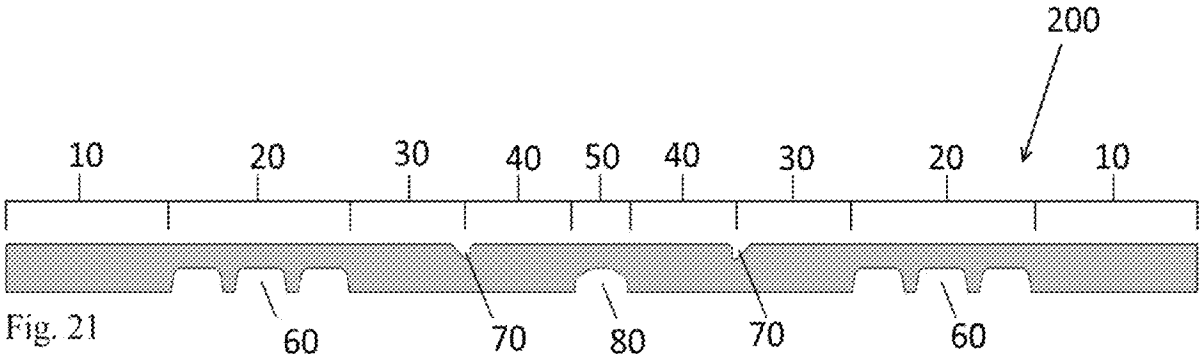
FIG. 22 is a schematic front elevation view in cross-section of the core of the topper of FIG. 21.

FIGS. 21 and 22 show a CNC cut foam mattress topper embodiment 200. As with all mattress embodiments, the topper is comprised of nine specialized deflection areas: head area 10, shoulder area 20, torso area 30, pelvic area 40 and trochanter area 50. The deflection channels 60 if the shoulder or low body area 20 provide shoulder elevation drop which reduces shoulder pressure by redistributing some of that pressure to the torso area 30. Torso/pelvic V-grooves 70, delimiting the torso and pelvic areas 30, 40 allows the heavier hip areas 40, 50 to deflect more than the adjacent torso area. The trochanter channel 80 extending from the lower surface reduces pressure on the greater trochanter 50.

Figure 23:
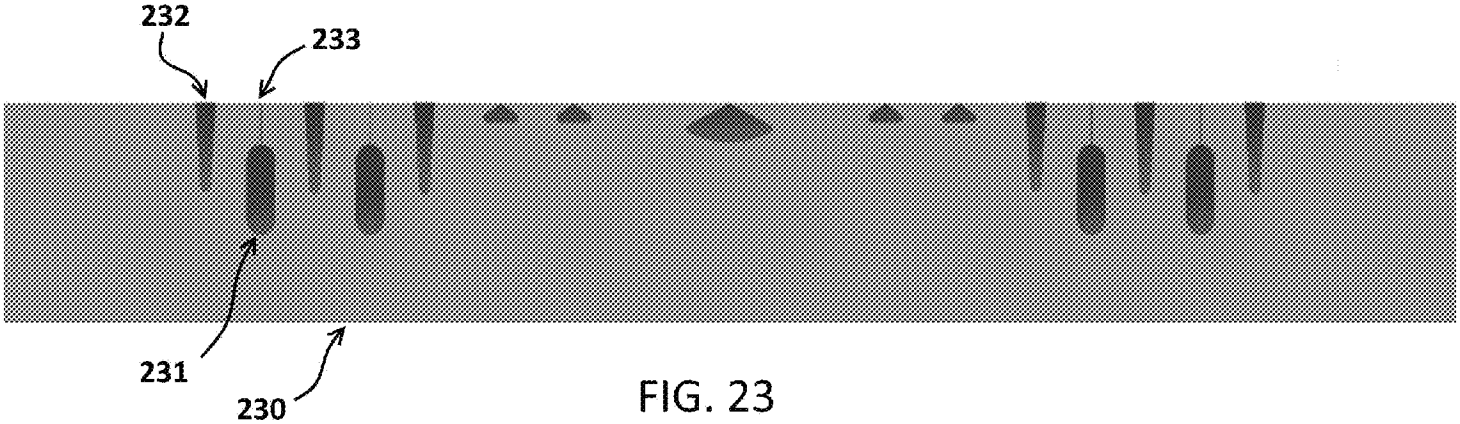
FIG. 23 is a schematic front elevation view in cross-section of a mattress in accordance with a twelfth embodiment of the invention
Figure 24:
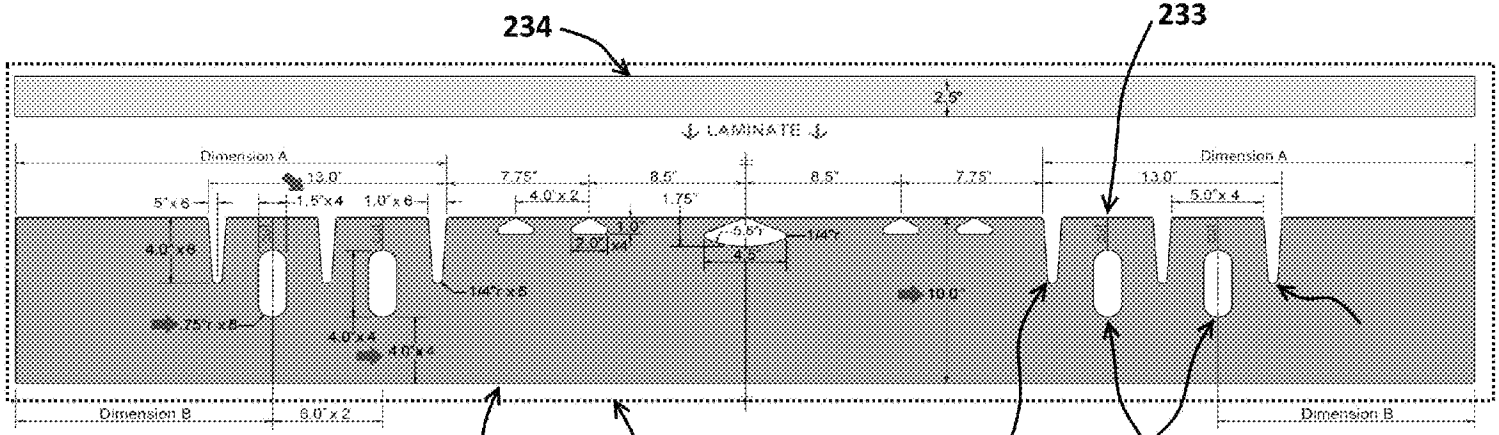
FIG. 24 is a schematic front elevation view in cross-section of the core of the mattress of FIG. 23 and a topper, including dimensions.

FIGS. 23 and 24 illustrate another embodiment of the mattress 230 comprising at least one internal lateral channel 231 operatively extending between two of said first lateral channels 232 inside the mattress. In the example illustrated on FIGS. 23 and 24, the foam mattress 230 comprises one internal lateral channel 231 between two of said first lateral channels 232, each internal lateral channel having preferably an ovoid cross-section. The ovoid channels 231 can be formed by cutting and removing the channel plugs through the top cuts 233. The ovoid channels 231 allow reducing shoulder pressure more than the vertically slotted shoulder area 232 without them. As illustrated on FIG. 24, the mattress 230 can be covered by a laminate or topper 234 before being wrapped in a zipped sleep cover 235 or the like.

Figure 25:
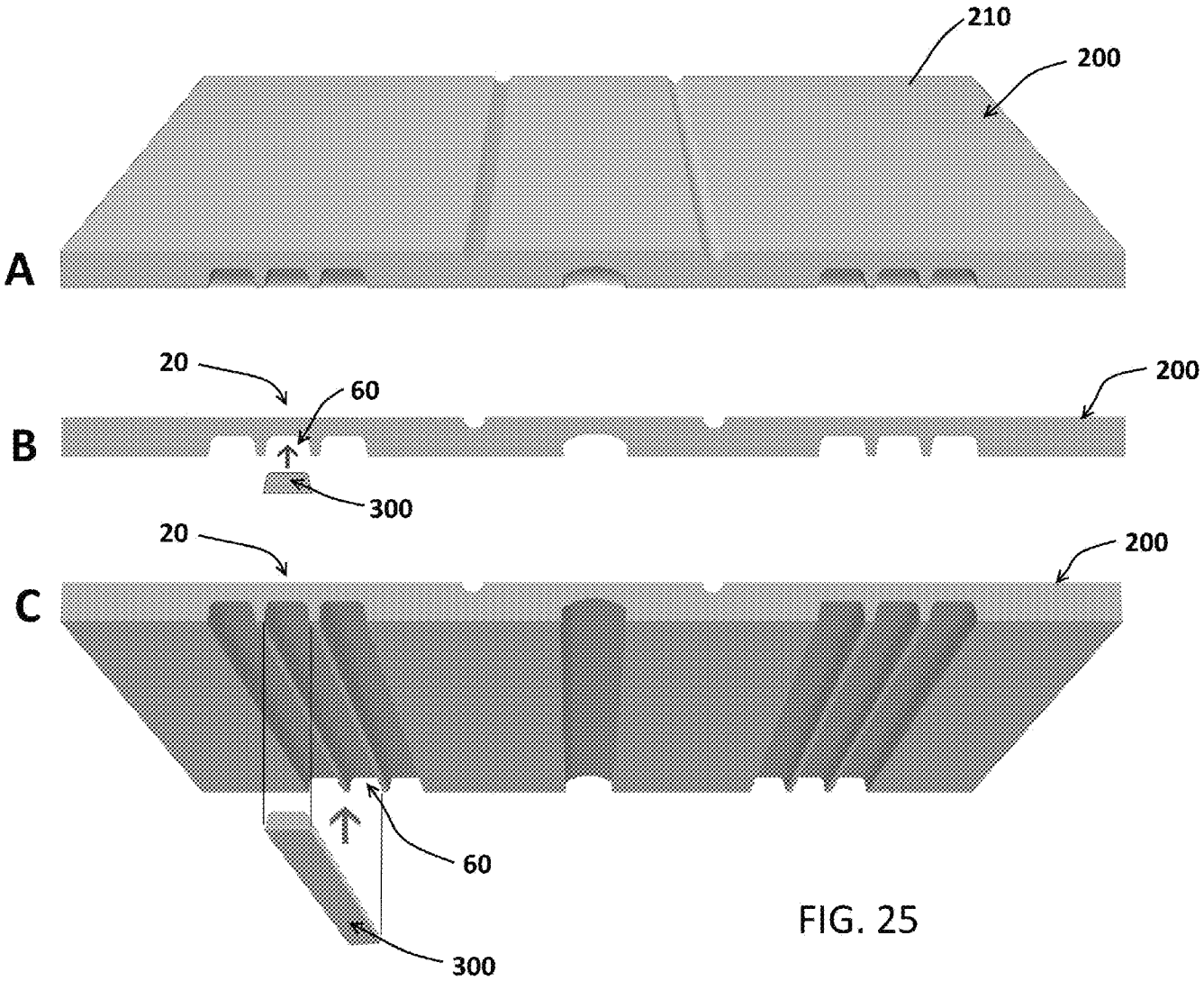
FIG. 25 shows a topper including an enhancer according to a preferred embodiment of the invention.

Mattresses or Toppers with Modulating Inserts:

Referring to FIG. 25, it is shown a perspective view of the mattress topper/enhancer 200 oriented as if lying on a mattress, with the flat area being the top 210 of the topper/enhancer. The zippered cover has been removed for clarity. Full width topper/enhancer insert 300 can be placed into the central channel 60 of the shoulder area 20 of the topper/enhancer. The insert is preferably a foam piece which has been contour cut to form the shoulder channel 60 and would otherwise be discarded if not used as the insert 300. Once the insert(s) have been placed in the channel(s) the zippered cover would be closed to maintain the topper and insert(s) all together.

Figure 26:
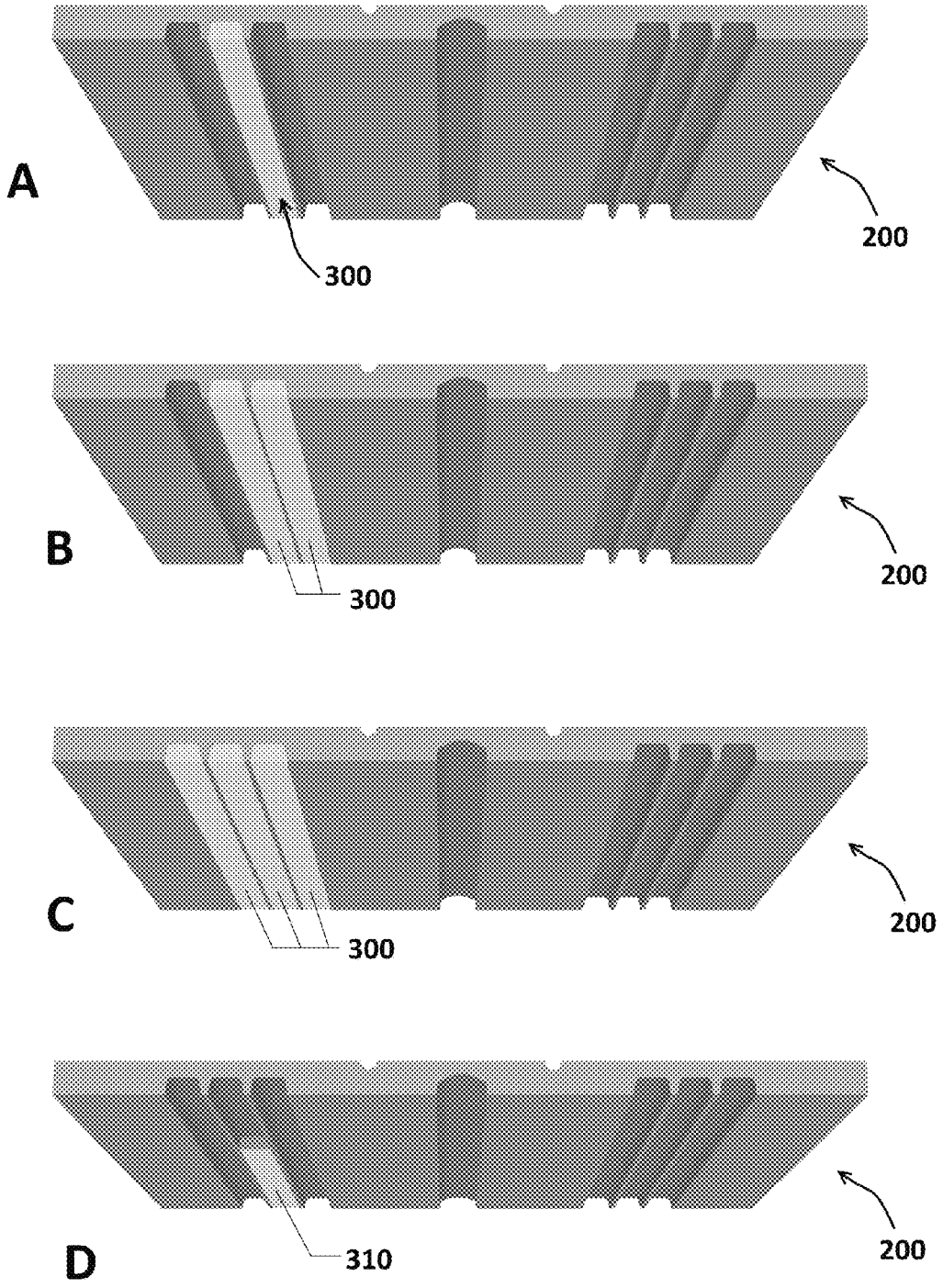
FIG. 26 shows toppers including full-length enhancers according to different preferred embodiments of the invention.
Figure 27:
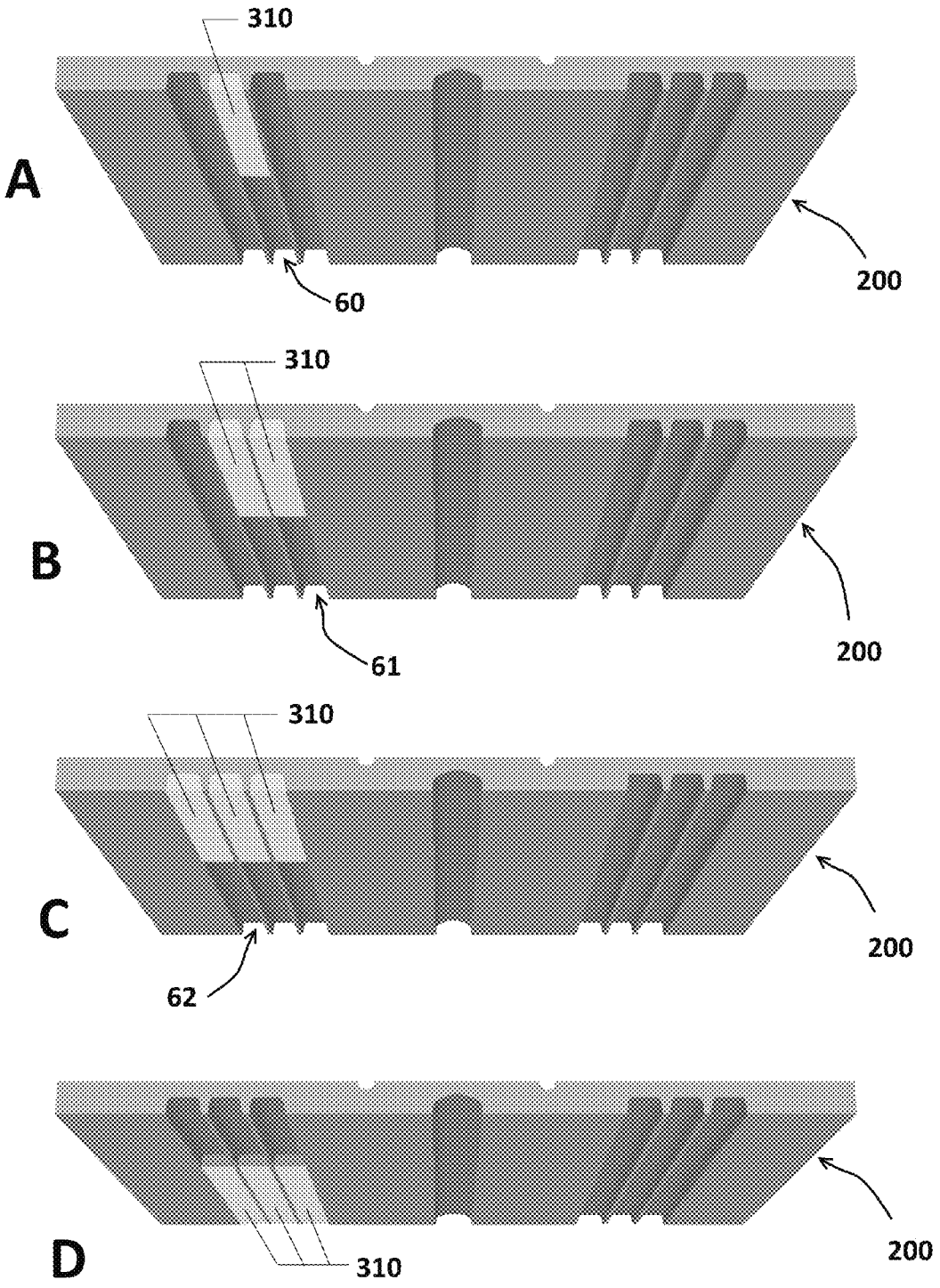
FIG. 27 shows a topper including half-length enhancers according to preferred embodiments of the invention.

Referring to FIG. 26, it is shown an insert placed into one channel (A), two channels (B) or three channels (C) as decided by the user's comfort preference. These inserts in this case are along the full width of the topper/enhancer 300 or a half-length inserts 310 that can be placed on one side only of the topper/enhancer. This would typically apply to a two-person-sized topper/enhancer like a Full, Queen or King sized bed, allowing each sleeper to customize the shoulder comfort on their side to his/her preference. FIG. 27 shows different examples of the many combinations of insert placements possible for individual customized comfort using half-length inserts 301.

There are many ways a sleeper can vary the firmness:

a. nothing in the slots (see FIG. 22A);
b. one insert 310 in the central slot 60 (see FIG. 24A); or into slot 61 or into slot 62;
c. two inserts 310 in the central slot 60 and slot 61 (see FIG. 22B); the central slot 60 and slot 62; or the slots 61 and 62; or
d. three inserts in slots 60, 61 and 62 on one side of the bed (FIG. 24 C) or the other side (FIG. 24D).

There are several advantages of the use of inserts/enhancers. First, the enhancers can be made from the cut-out of the foam mattress when cutting the channels reducing foam waste. Second, the use of the enhancers allows precisely and easily customizing the user's sleeping comfort, one side of the bed or both sides.

Methods:

The present invention also concerns a method for customizing the comfort of a mattress, comprising at least the steps of:

a) providing a mattress or a topper as disclosed herein with the plurality of slots and/or voids cut into the foam for supporting each area of the person body in a specific way to control postural alignment while providing ultra-low mattress-body interface pressures for all body areas regardless of recumbent position;
b) providing cut-outs of foam obtained during the manufacturing of the mattress or topper when making the slots and/or voids; and
c) reinserting one or several cut-outs in the slots and/or voids at least along a section of the slots and/or voids for customizing or adjusting the postural alignment.

Figure 28:
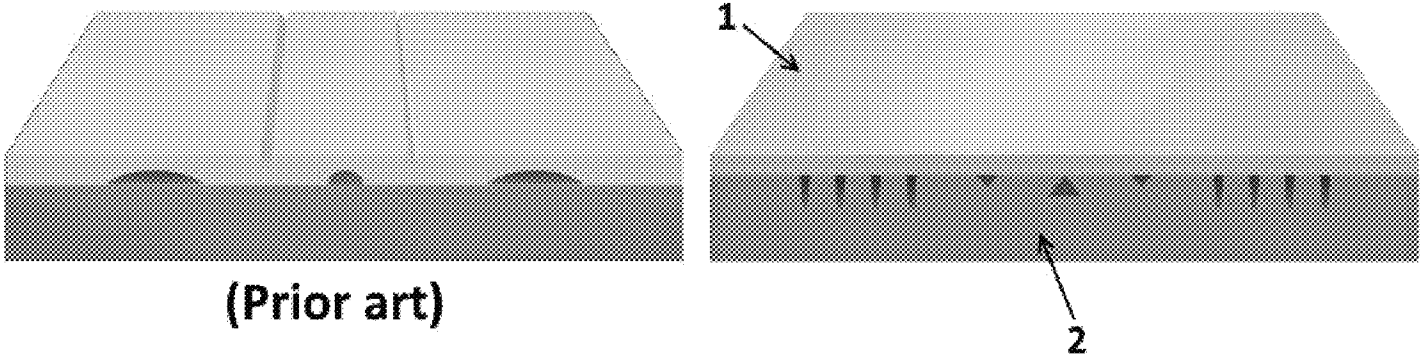
(Prior art) FIG. 28
FIG. 28 compares a mattress of the prior art with a mattress in accordance with a preferred embodiment of the invention.

Referring to FIG. 28, the deflection areas of the top mattress section of the prior art: WO 2016/023109, may be prone to several deficiencies:

1. The depth of the foam above the shoulder "tunnel" is limited which allows the firmer base foam (darker) to feel more prominent in that area than desired.
2. The height to width ratio of the shoulder "tunnel" tends to allow a permanent non-recoverable body impression in that area under heavier loads.
3. The vertical deflection capability of the shoulder area is less than desired.
4. Since the top mattress section requires a 3" height to perform, and the desired overall height is 10", the base foam must be 7" which is marginal in preventing "bottoming out", or approaching a terminal firmness which can defeat the ultra-low pressure parameter.

Still referring to FIG. 28, the mattress of the present invention may solve the above-mentioned deficiencies of the prior art:

1. The vertical tapered slots in the shoulder area provide Indention/Force/Deflection (IFD) reduction of the foam to prevent the firmer feel of an un-modified shoulder area.
2. The top mattress section is supported by the un-slotted (land) areas of the base foam, preventing any significant body impressions to form.
3. The slotted shoulder area provides both the IFD reduction and deflection desired for both back and side-lying comfort.
4. The support provided by the slotted shoulder area allows an 8" base foam which prevents "bottoming out".
5. Moreover, the slotted design allows greater flexibility to fine tune future support and firmness parameters.

How slot and void size/shape/placement affect foam support, firmness and deflection:

1. Un-slotted foam has the most support and firmness and most resistance to deflection.
2. The width of a given vertical slot in relation to the width of the adjacent un-slotted foam determines the IFD reduction of the foam (softening).
3. The depth of a given vertical slot determines the depth to which the IFD reduction (softening) acts.
4. A vertical slot releases the horizontal tensile forces inherent in un-slotted foam.
5. A vertical slot creates an "edge effect" whereby the foam IFD is lower near the foam edge than the foam middle.
6. A void's shape determines the adjacent foam's compression characteristics.

Figure 29:
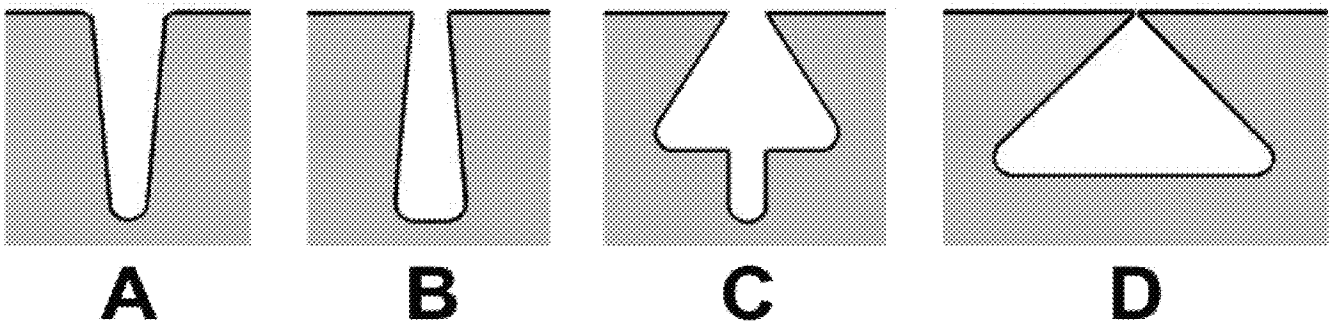
FIG. 29 illustrates different slots or channels in the mattress in accordance with four preferred embodiments of the invention.

Referring to FIG. 29, pic A, the foam adjacent to the top of the slot will compress more easily than at the bottom. Tensile release occurs to the lowest point of the slot. The cross sectional area of the slot relative to the adjacent cross sectional foam area determines the IFD reduction.

Referring to FIG. 29, pic B, the foam adjacent to the bottom of the slot will compress more easily than at the top. Tensile release occurs to the lowest point of the slot. The cross sectional area of the slot relative to the adjacent cross sectional foam area determines the IFD reduction.

Referring to FIG. 29, pic C, the foam adjacent to the "arrowhead" area will compress more easily than the foam adjacent to the "arrow stem". With a larger arrowhead void area than either pic A or B at the same depth, it will compress more easily at the same depth under the same load. Tensile release occurs to the lowest point of the void. The cross sectional area of the void relative to the adjacent cross sectional foam area determines the IFD reduction.

Referring to FIG. 29, pic D, the void is similar to the arrowhead of pic C. But with smaller arrowhead angles, the adjacent foam will compress more easily under the same load. Tensile release occurs to the lowest point of the void. The cross sectional area of the void relative to the adjacent cross sectional foam area determines the IFD reduction.

Figure 30:
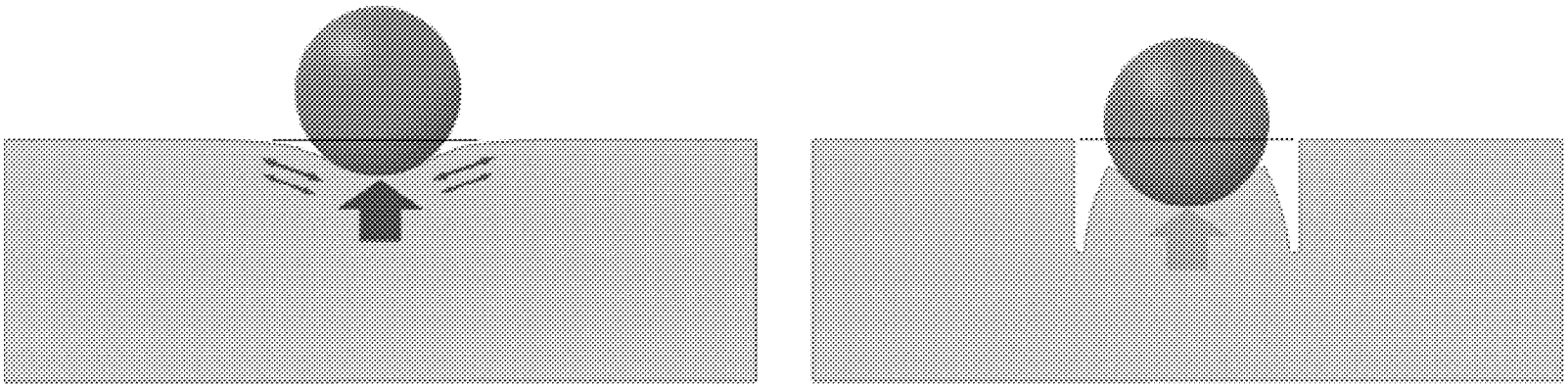
FIG. 30 illustrates the difference of deflection between a regular topper or mattress with no slots (left) with a topper or mattress with slots in accordance with a preferred embodiment of the invention.

FIG. 30 illustrates how foam without slots or voids (left) compares to foam with tensile release slots (right). Even though polyurethane and other flexible foams have a very low Young's modulus, tensile release dramatically reduces the foam tensile forces which act to restrict compression. The result is greater deflection and greater contact area. Greater contact area equates to lower pressure per unit area, which can be extremely important in the present application.

The flexibility to control both area deflection and mattress/body interface pressures by slot or void size, depth, shape and placement comprises a new and better way to manufacture mattresses and toppers. No other mattress or topper manufacturing process has this ability to fine tune and control comfort parameters, whether based on consumer preferences or other decision factors.

Indentation force-deflection (IFD) is a process used in the flexible foam manufacturing industry to assess the "softness" of a sample of foam such as memory foam. To conduct an IFD test, a circular flat indenter with a surface area of 323 square centimeters (50 sq. inches-8" in diameter) is pressed against a foam sample usually 100 mm thick and with an area of 500 mm by 500 mm (ASTM standard D3574). The foam sample is first placed on a flat table perforated with holes to allow the passage of air. It is then "warmed up" by being compressed twice to 75% "strain", and then allowed to recover for six minutes. The force is measured 60 seconds after achieving 25% indentation with the indenter. Lower scores correspond with less firmness; higher scores with greater firmness. U.S. measurements are given in pounds-force, and European ones are given in Newton (N).

In the mattress case, the top 2" foam layer would typically be 19-21 IFD. The 8" base layer would typically be 25-27 IFD. Firmer or softer IFD's can be used, but quickly exit the "comfort zone" for most people. The topper would typically be 19-21 IFD. (see IFD definition below).

The foam used for the making of the mattresses or toppers disclosed herein are selected from the foams generally used in the art of making foam mattress or toppers. For instance, the foam may comprise flexible polyurethane (including modified polyurethanes such as visco-elastic PE foam), latex or any other type of flexible foam.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

What is claimed is:

1. A foam mattress or topper for controlling a whole body alignment of a person laid on the foam mattress or topper, the foam mattress or topper comprising:

an upper and lower surface, the upper surface defining:

a longitudinal direction allowing for longitudinally receiving the person, and a plurality of mattress areas comprising:

an upper body receiving area for supporting the person's upper body and shoulders;

a lower body receiving area for supporting the person's lower body; and a middle body receiving area for supporting the person's hip;

a plurality of first lateral channels extending from the lower surface into the upper body receiving area and extending in a lateral direction perpendicular to the longitudinal direction of the mattress or topper; the first lateral channels thereby allowing the upper body receiving area above the first lateral channels to displace downward to provide pressure reduction and alignment for the shoulder of the user's body; and at least one first insert configured to fill, at least partially, at least one of said first lateral channels for modulating the pressure reduction and alignment of the upper body and the shoulder of the person.

2. The foam mattress or topper of claim 1, wherein:

said at least one first insert and the mattress or topper are obtained by cutting out the foam from the mattress or topper to form said plurality of first lateral channels during the manufacture of the mattress or topper.

3. The foam mattress or topper of claim 1, wherein the mattress or topper defines two longitudinal sides of the mattress or topper, and wherein:

the at least one inserts are full-length inserts configured to fill a width of the mattress or topper allowing modulating the pressure and comfort on both sides of the mattress or topper; or the at least one inserts are half-length inserts configured to be placed on one side of said longitudinal sides only allowing to modulating the pressure reduction and comfort on one side of the mattress or topper.

4. The foam mattress or topper of claim 1, further comprising:

a second lateral channel extending from the lower surface into the middle body receiving area and extending in the lateral direction perpendicular to the longitudinal direction of the mattress;

the second lateral channel thereby allowing the middle body receiving area above the second lateral channel to displace downward to provide pressure reduction and alignment for the hip of the person.

5. The foam mattress of claim 4, further comprising:

a second insert configured to fill, at least partially, the second lateral channel for modulating the pressure reduction and alignment for the hip of the person.

6. The foam mattress or topper of claim 1, further comprising:

a plurality of third lateral channels extending from the lower surface into the lower body receiving area and in the lateral direction perpendicular to the longitudinal direction of the mattress or topper;

the third lateral channels thereby allowing the lower body receiving area above the third lateral channel to displace downward to provide pressure reduction and alignment for the lower body of the person.

7. The foam mattress or topper of claim 6, further comprising:

at least one third insert configured to fill, at least partially, at least one of the third lateral channels for modulating the pressure reduction and alignment for the lower body of the person.

8. A method for customizing or adjusting the postural alignment of a person laid on a foam mattress or topper, the method comprising the steps of:

providing a mattress or topper as defined in claim 1; and removing, at least partially, at least one of the first inserts from at least one of the first lateral channels providing as such pressure reduction for the shoulder of the person; and/or inserting, at least partially, at least one of the first inserts into at least one of the first lateral channels providing as such pressure augmentation for the shoulder of the person.

* * * * *